US005510671A

United States Patent [19]

Nakamura et al.

[11] Patent Number: 5,510,671

[45] Date of Patent: Apr. 23, 1996

[54] INWARDLY CONVEX VACUUM ENVELOPE

[75] Inventors: Koji Nakamura, Nagaokakyo; Keitaro Tsukui; Kenichi Umino, both of Amagasaki, all of Japan

[73] Assignee: Mitsubishi Denki Kabushiki Kaisha, Tokyo, Japan

[21] Appl. No.: 187,478

[22] Filed: Jan. 28, 1994

[30] Foreign Application Priority Data

Mar. 9, 1993 [JP] Japan ..... 5-048008

[51] Int. Cl.[6] ..... H01J 31/00; H01J 61/30

[52] U.S. Cl. ..... 313/477 R; 220/2.1 R; 220/2.1 A

[58] Field of Search ..... 313/422, 477 R; 220/2.1 R, 2.3 A, 2.1 A

[56] References Cited

U.S. PATENT DOCUMENTS

| | | | |
|---|---|---|---|
| 2,255,431 | 9/1941 | Marden et al. | 220/2.1 R |
| 2,760,119 | 8/1956 | Toulon | 313/422 |
| 3,064,154 | 11/1962 | Law | 313/422 |
| 4,180,760 | 12/1979 | Chang | 313/422 |
| 4,808,890 | 2/1989 | Yamazaki | 313/422 |

FOREIGN PATENT DOCUMENTS

| | | | |
|---|---|---|---|
| 1220344 | 9/1989 | Japan . | |
| 221545 | 1/1990 | Japan . | |
| 404160721A | 6/1992 | Japan | 313/477 R |

*Primary Examiner*—Sandra L. O'Shea
*Assistant Examiner*—Vip Patel

[57] ABSTRACT

A display device capable of bearing the stress due to vacuum condition and capable of reducing both weight and depth simultaneously, by incorporating a vacuum envelope with glass screen having a front section made in a curved panel and a rear section being concave toward the inside of the vacuum envelope.

18 Claims, 9 Drawing Sheets

INWARDLY CONVEX VACUUM ENVELOPE

BACKGROUND OF THE INVENTION

1. Field of the invention

The present invention relates to a display device used in television receivers, computer terminal displays, and similar apparatuses.

2. Description of Related Art

The envelope with glass screen (hereinafter called as an envelope) of a display device, wherein electron beams are used to make phosphor illuminate, thereby displaying picture images, is required to satisfy the conditions of a vacuum vessel.

The envelope of the prior art is made entirely of glass including the front section provided with the fluorescent screen on the inner surface thereof, both side sections, top section, bottom section and rear section, in a constitution satisfactory in terms of reliability. However, the envelope made of glass is liable to cause delayed fracture by the stress generated by making the inner space vacuum, eventually leading to breakage. This problem may be countered by choosing a proper thickness for the glass wall, although this leads to an increase in the weight of the entire envelope which contradicts the trend toward less weight of products.

Another method of preventing the delayed fracture is to use glass only in the front section of the envelope and make the other parts with a metal. Because the use of a metal decreases a possibility of delayed fracture to occur, there is no need to increase the wall thickness as in case of glass, and therefore the weight of the device can be decreased.

FIG.1 is a perspective view illustrative of only the envelope of a flat type display device. FIG. 2 is a schematic longitudinal sectional drawing of the portion cut by line II—II. The envelope comprises a front section 1 including a glass panel provided with a fluorescent screen on the inner surface thereof and other parts made of a metal, that are both side sections 5, 5, a top section 2, a bottom section 3 and a rear section 4. The envelope has inner components such as electrodes to produce picture images being installed therein, however, they are not shown in the drawing.

The glass is the cathode ray tube material H5702 specified by the Electronic Industries Association of Japan, for example, and is made in height/width ratio of ¾ and diagonal screen size of 20 inches. The metallic material is cord-rolled steel #430. Thickness T1 of the glass panel of the front section 1 is 26.4 mm, thickness T2 of the metal sheet on the four circumferential sections (both side sections 5, 5, top section 2, bottom section 3) is 5.5 mm, and thickness T3 of the metal sheet on the rear section 4 is 5.5 mm, and depth D of the envelope formed by the front section 1 and the rear section 4 is 60 mm. Weight of this constitution is 25.9 kg.

Joint A in the front section 1 between the glass panel and the metal sheet forming the four circumferential sections will now be described below. FIG. 3 and FIG. 4 are enlarged views illustrative of two examples of the joint A. In the constitution shown in FIG. 3, the glass panel 1*a* has a groove on the edge thereof to allow the metal sheet to be inserted therein. An end of the metal sheet 2*a* constituting the top section 2 is bent toward the front section and is inserted into the groove. The metal and glass of the joint are bonded by fusing. In the constitution shown in FIG. 4, metal sheet 2*a* bent toward the front section similarly to that of FIG. 3 and the edge of the glass panel 1*a* are placed on one another and are bonded by means of frit glass 6.

FIG. 5 is a schematic longitudinal sectional drawing illustrative of an envelope of a display device which is made lighter than the display device shown in FIG. 1, FIG. 2. The envelope is made in rounded shape to reduce the stress and thereby making it possible to reduce both the thickness and the weight. Radius of curvature R1 of the front section 1 is 1738 mm, radius of curvature R2 of the top and bottom sections 2, 3 is 30 mm, and radius of curvature R3 of the rear section 4 is 884 mm. T1 is 16.0 mm, T2 is 2.4 mm and T3 is 1.0 mm, and weight of this constitution is made as small as 10.3 kg. The stress generated by pumping out the envelope to make the inside vacuum is 1 kgf/cm$^2$ in the front section 1 made of glass, and 15 kgf/cm$^2$ in sections made of the metal. However, depth D becomes 20+60+40=120 mm because the front section 1 and the rear section 4 are made to protrude toward the outside of the envelope.

As described above, changes in the depth and in weight of a display device, namely an envelope, are in a contradictory relationship in the conventional device, and it has been difficult to decrease the weight and depth simultaneously.

SUMMARY OF THE INVENTION

The present invention has been devised to solve the problems described above, and the object of the invention is to provide a display device capable of achieving weight reduction and depth reduction at the same time by modifying the configuration of the vacuum envelope with glass screen.

The display device of the invention has a rear section made in a curved surface being convex toward the inside of the vacuum envelope and a front section made in a curved surface. Thus by making the rear section in a concave configuration, it can be made in a curved configuration without increasing the depth, thereby enabling it to accommodate the stress caused by the vacuum condition and avoiding the increase in weight.

The display device of the invention has the front section which is made in a curved surface being convex toward the outside of the vacuum envelope, in addition to the concave rear section. Thus by making the front section in a curved panel, it is made possible to accommodate the stress caused by the vacuum condition, thereby avoiding the increase in weight.

The display device of the invention has the rear section made in a concave shape and the front section made in a curved surface being convex toward the inside of the vacuum envelope. Therefore, strength to bear the stress can be obtained with a depth similar to that of the flat type conventional display device, and weight reduction is also made possible.

The above and further objects and features of the invention will more fully be apparent from the following detailed description with accompanying drawings.

DESCRIPTION OF THE PREFERRED EMBODIMENTS

Preferred embodiments of the invention will now be described in detail below with reference to the attached drawings.

Figure 3:
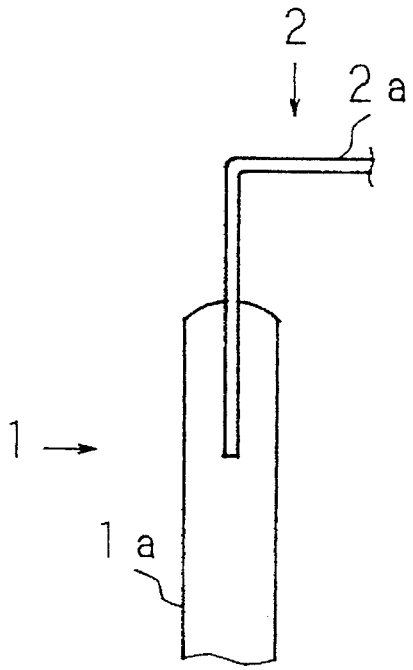
Fig. 3 Prior Art
FIG. 3 is a schematic drawing illustrative of the joint between glass panel and metal sheet in the front section.
Figure 4:
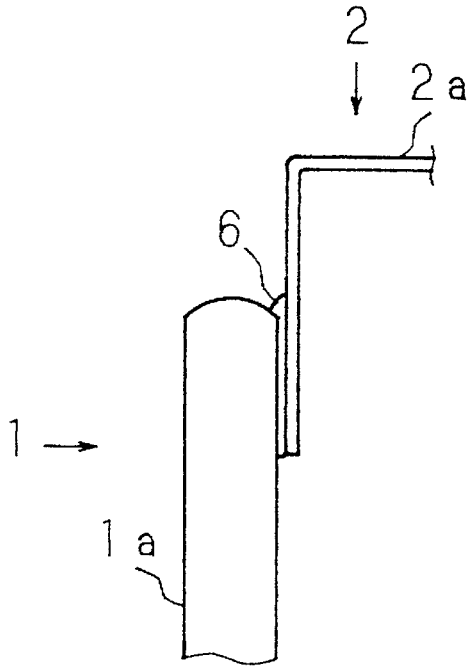
Fig. 4 Prior Art
FIG. 4 is a schematic drawing illustrative of the joint between glass panel and metal sheet in the front section.
Figure 6:
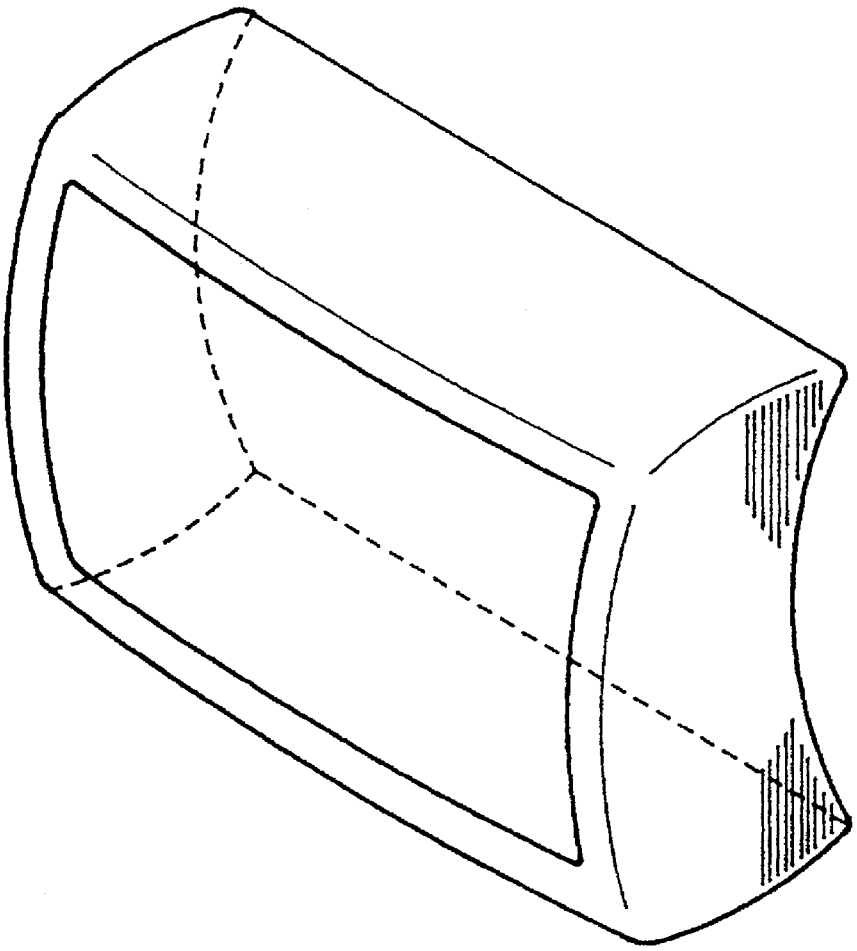
FIG. 6 is a schematic perspective drawing of the display device of the invention.
Figure 7:
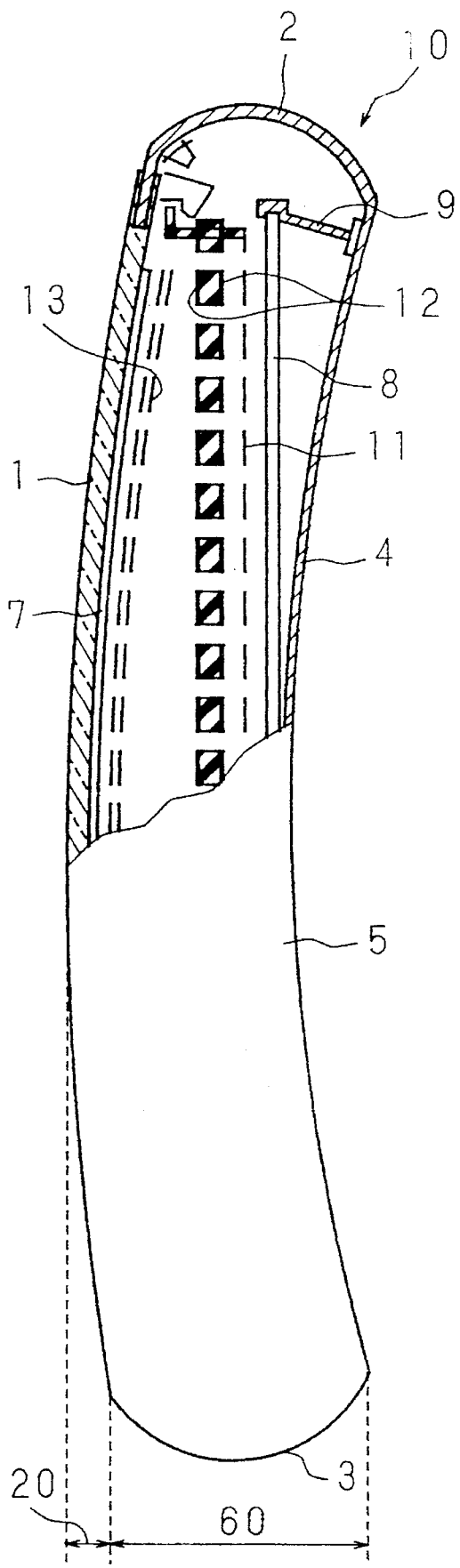
FIG. 7 is a partially broken side view drawing of the display device of the invention.

FIG. 6 is a schematic perspective drawing illustrative of the display device of the invention, and FIG. 7 is a partially broken side view drawing of the display device. In these drawings, numeral 10 denotes an envelope comprising a front section 1 protruding toward the outside including a glass panel provided with a fluorescent screen 7 on the inner surface thereof with a radius of curvature R1 being 1738 mm, both side sections 5 made of a metal, a top section 2 made of the metal, a bottom section 3 made of the metal and a rear section 4 made of the metal being concave toward the inside with a radius of curvature R3 being 884 mm. The Four circumferential sections (both side section 5, top section 2, bottom section 3) protrude slightly toward the outside with a radius of curvature 30 mm. In the joint between the front section 1 and the four circumferential sections, the glass panel 1*a* has a groove on the edge thereof to allow the metal sheet to be inserted therein as shown in FIG. 3. An end of the metal sheet 2*a* constituting the top section 2 is bent toward the front section and the tip thereof is inserted into the groove. These components are bonded by fusing.

The envelope 10 has inner components installed therein to display picture images, with an electron gun among these inner components being shown in FIG. 7, but is omitted in FIG. 6. Numeral 8 in the drawing denotes filament-shaped cathode electrodes which emit a plurality of electron beams. A plurality of cathode electrodes 8 are fastened substantially in parallel on the inside of the rear section 4 by a metal frame 9. A second electrode 11 made of a flat metal sheet having a multitude of apertures, a matrix electrode 12 holding an insulator between two metal electrodes and having a multitude of apertures, and a focusing electrode 13 made of a flat metal sheet having a multitude of apertures are fastened in this order, being separated by specified distance from each other, in front of the cathode electrode 8. These electrodes constitute the electron gun.

In the envelope constituted as described above, the four circumferential sections are divided into two parts in the direction of depth and the two parts are welded to seal the inner space wherein the inner components are installed. Then the inside of the display device is pumped out to make the inner space vacuum. In the display device of this constitution, a plurality of electron beams emitted from the cathode electrodes 8 are made to pass through the multitude of apertures made in each of the second electrode 11, the matrix electrode 12 and the focusing electrode 13, and illuminate the fluorescent screen 7.

The glass is the cathode ray tube material H5702 specified by the Electronic Industries Association of Japan, for example, and is made in height/width ratio of ¾ and diagonal screen size of 20 inches. The metallic material is cold-rolled steel #430. Thickness T1 of the glass panel of the front section 1 is 16.0 mm, thickness T2 of the metal sheet on the four circumferential sections is 2.3 mm, and thickness T3 of the metal sheet on the rear section 4 is 1.O mm.

Figure 1:
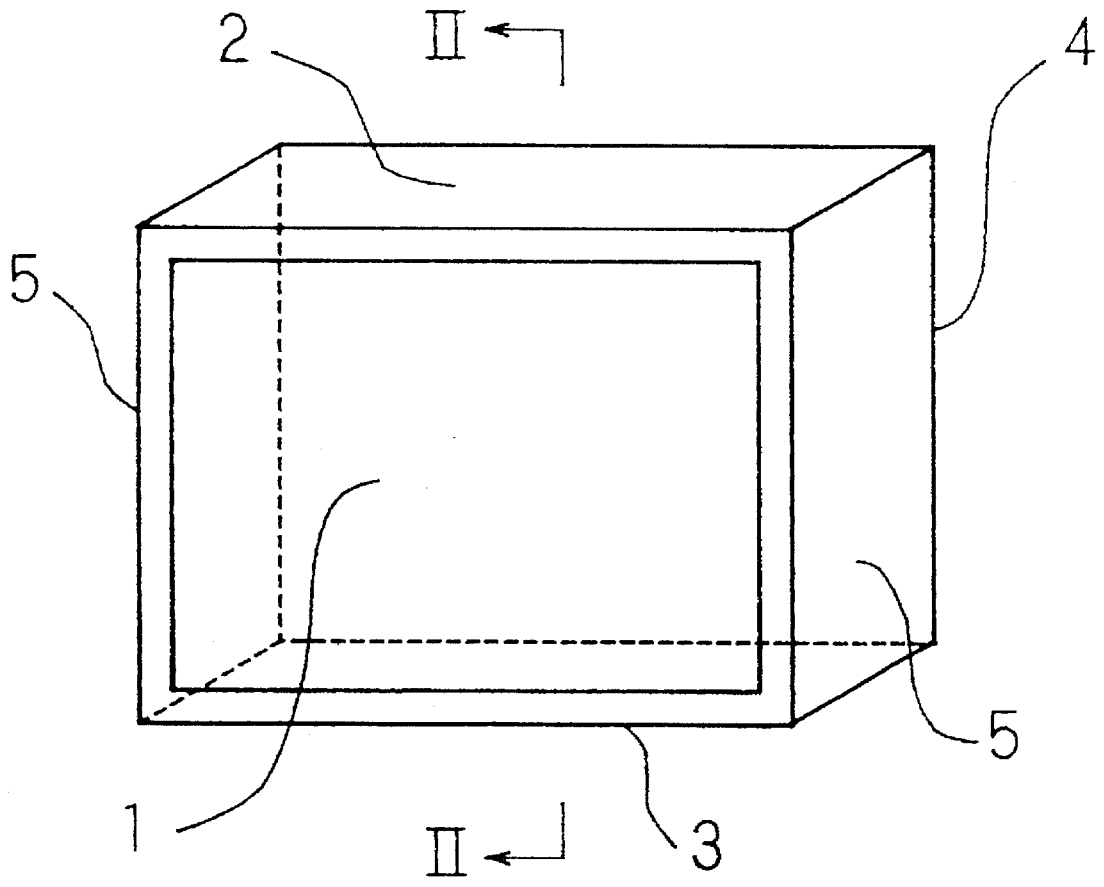
Fig. 1 Prior Art
FIG. 1 is a perspective drawing of the envelope of a conventional display device.
Figure 2:
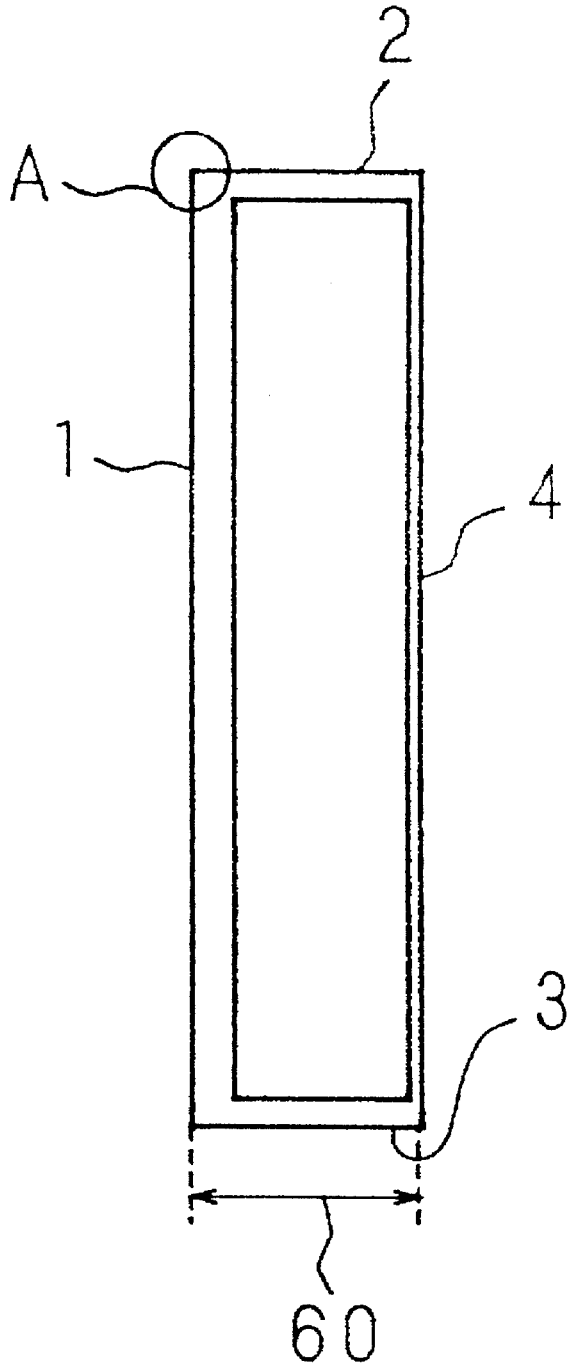
Fig. 2 Prior Art
FIG. 2 is a schematic longitudinal sectional drawing of the portion cut by line II—II.
Figure 5:
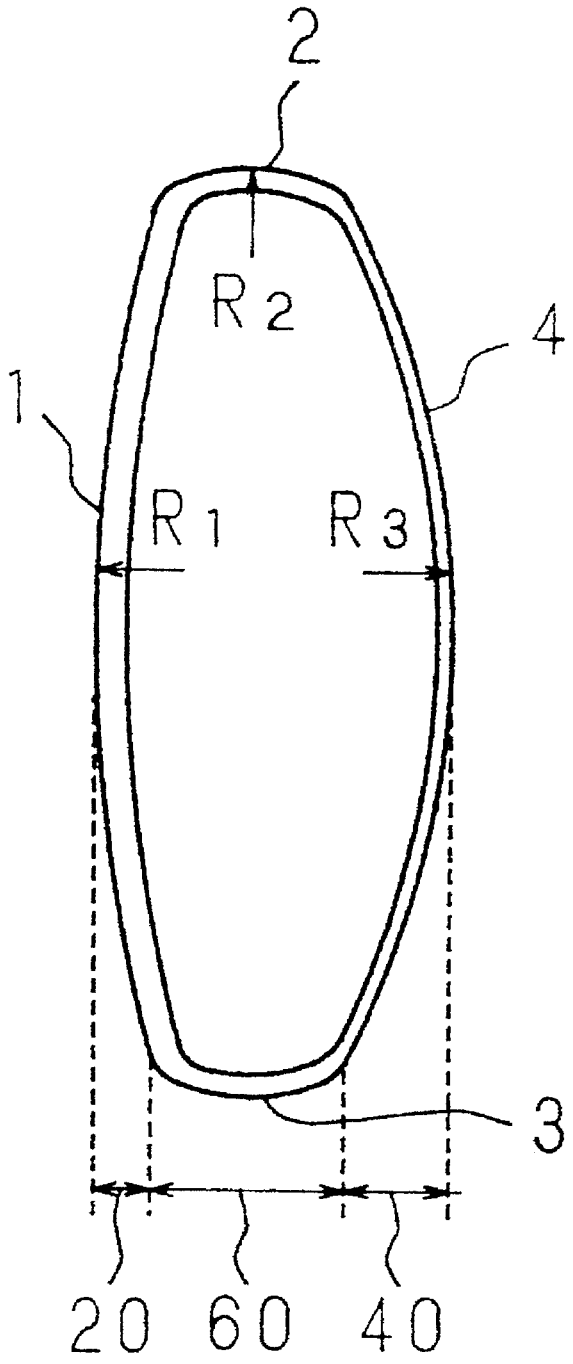
Fig. 5 Prior Art
FIG. 5 is a schematic sectional drawing of the conventional display device.

The stress generated by pumping out the envelope to make the inside vacuum is 1 kgf/cm$^2$ in the front section 1 made of glass, and 15 kgf/cm$^2$ in sections made of the metal. Depth D of the envelope is 20+60=80 mm, being 33% less than that shown in FIG. 5. Weight of this constitution is 10.3 kg, being same as that shown in FIG. 5, and is less than that of the flat type display device shown in FIG. 1 and FIG. 2.

Figure 8:
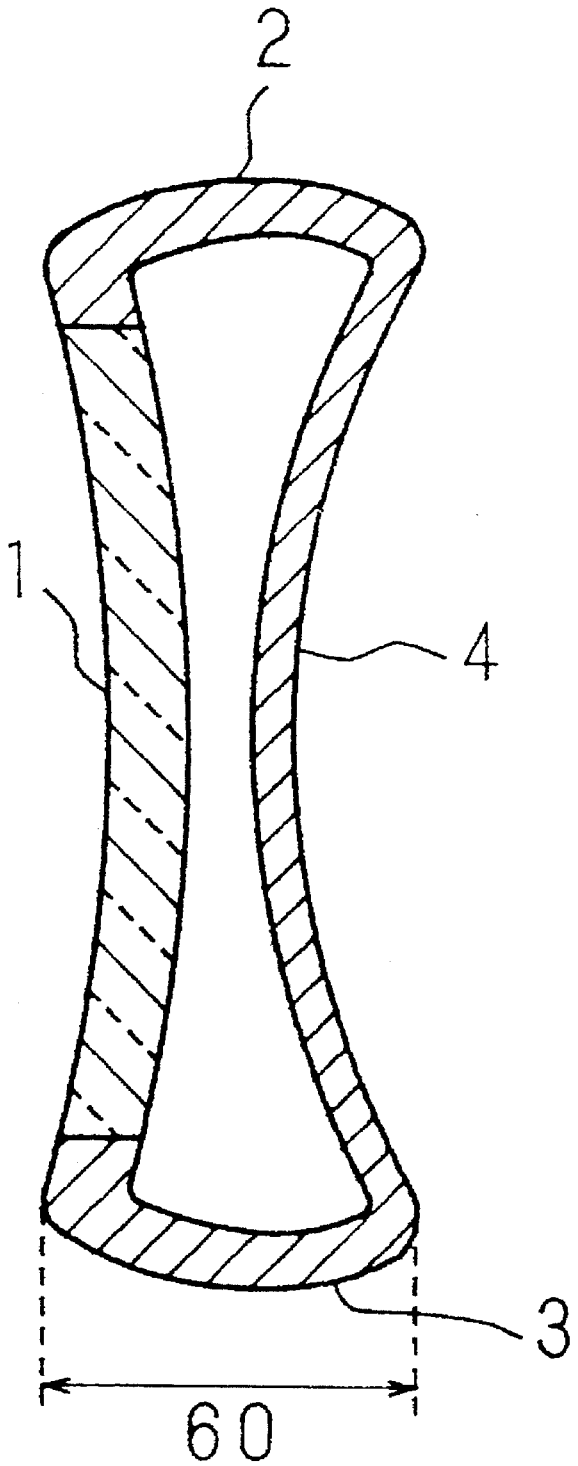
FIG. 8 is a schematic longitudinal sectional drawing illustrative of another embodiment of the envelope of the display device of the invention.

FIG. 8 is a schematic longitudinal sectional drawing illustrative of another embodiment of the display device of the invention. In this embodiment, the front section 1 is made in such a configuration as concave toward the inside having a radius of curvature R1 of 1.738 mm. Except for this, the constitution is similar to those shown in FIG. 6, FIG. 7, and the inner components are omitted. In this constitution, although weight and stress are similar to those of the display device shown in FIG. 6 and FIG. 7, depth D can be reduced to 60 mm, realizing a small-depth display device similar to the conventional flat type display device. Depth can be further reduced to the extent that the inner components can be installed further inside.

Figure 9:
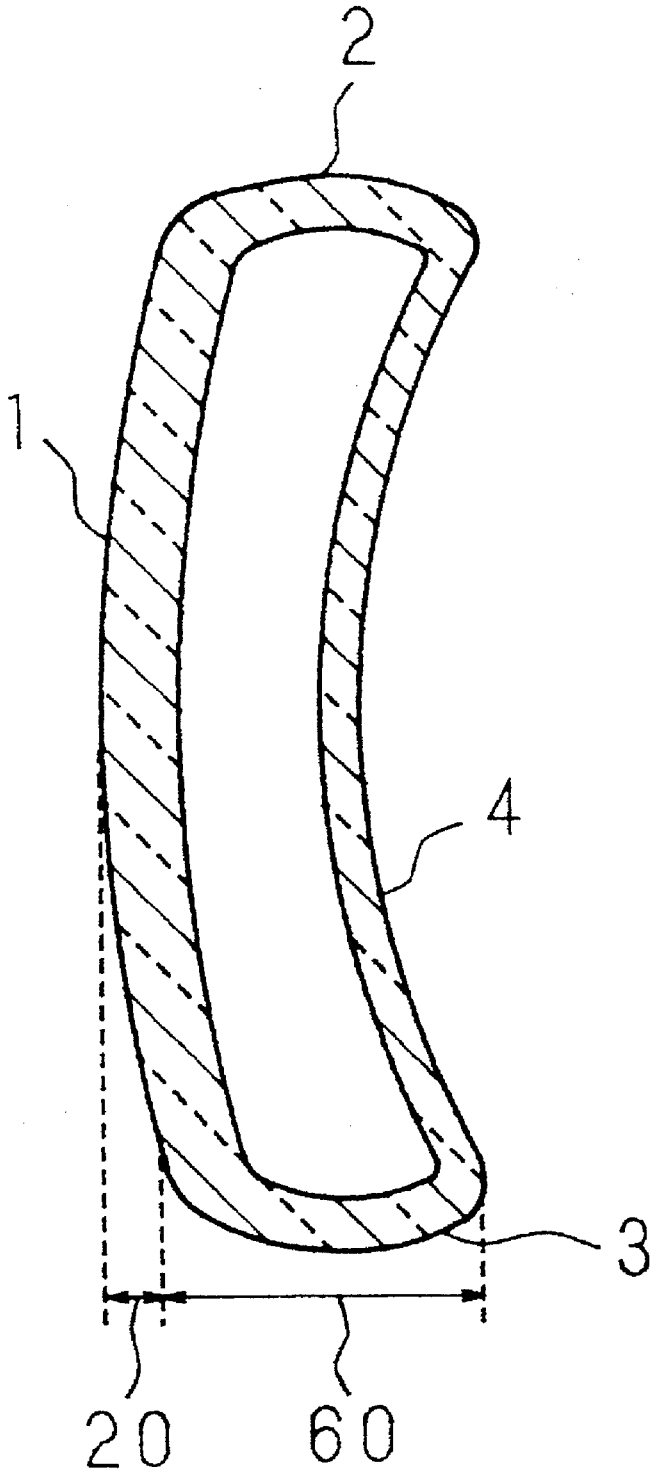
FIG. 9 is a schematic longitudinal sectional drawing illustrative of another embodiment of the envelope of the display device of the invention.
Figure 10:
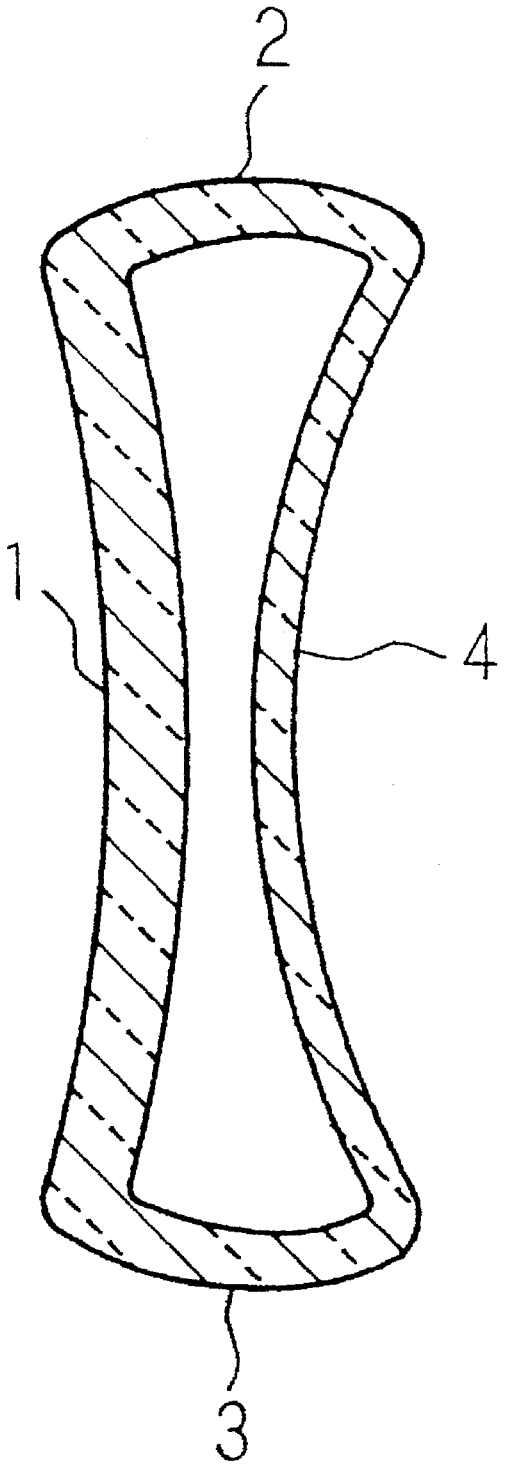
FIG. 10 is a schematic longitudinal sectional drawing illustrative of still another embodiment of the envelope of the display device of the invention.

Although only the front section 1 is made of glass with the rest being made of metallic material in the above embodiments, an envelope entirely made of glass including the rear section may also be used. FIG. 9, FIG. 10 are schematic longitudinal sectional drawings of display devices in another embodiments of the invention, with an envelope entirely made of glass. FIG. 9 shows a constitution with the front section being concave toward the inside, and FIG. 10 shows a constitution with the front section being convex toward the inside. Except for this, the other constitutions are similar to that shown in FIG. 7, and the inner components are omitted.

Because the stress due to the vacuum condition can be reduced in such configurations as described above, thickness of the glass can be reduced even when the envelope is made entirely of glass, and therefore weight and depth can be made less than those of the conventional display device made of glass.

As described above, the display device of the invention is made in curved sheet configuration without increasing the depth, by making the rear section of the vacuum envelope in a concave shape, thus making it possible to accommodate the stress due to the vacuum condition and to avoid increase in the weight. Also because the front section is made in a curved surface, it is made possible to accommodate the stress due to the vacuum condition and to avoid an increase in the weight. Further by making the front section in a curved panel being concave toward the inside, sufficient strength to bear the stress is obtained with a depth similar to that of the conventional flat type display device, and the weight can be reduced. Thus the invention has remarkable effects as described above.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A display device for displaying picture images, comprising:

an electron gun for generating electron beams that irradiate a fluorescent screen; and a vacuum envelope with a glass screen having a substantially evacuated inside and said electron gun installed therein said vacuum envelope including, a front section having a curved surface provided with said fluorescent screen and having an inwardly convex shape which curves toward the inside of said vacuum envelope, and a rear section having an inwardly convex shape which curves toward the inside of said vacuum envelope.

2. The display device of claim 1, further comprising:

a circumferential section bonded with said front section and said rear section to form said vacuum envelope, wherein said rear section and said circumferential section are made of a metal.

3. The display device of claim 2, wherein said circumferential section forms a peripheral portion of said front section and wherein said front section is made of glass and is provided with a groove that permits insertion and bonding of said circumferential section.

4. The display device of claim 1, further comprising:

a circumferential section bonded with said front second and said rear section to form said vacuum envelope, wherein said rear section and said circumferential section are made of glass.

5. The display device of claim 1, further comprising:

a circumferential section bonded with said front section and said rear section to form said vacuum envelope, wherein said rear section and said circumferential section are made of metal.

6. The display device of claim 5, wherein said circumferential section forms a peripheral portion of said front section and wherein said front section is made of glass and is provided with a groove that permits insertion and bonding of said circumferential section.

7. The display device of claim 1, further comprising:

a circumferential section bonded with said front section and said rear section to form said vacuum envelope, wherein said rear section and said circumferential section are made of glass.

8. The display device of claim 1, further comprising:

a circumferential section bonded with said front section and said rear section to form said vacuum envelope, wherein said rear section and said circumferential section are made of metal.

9. The display device of claim 8, wherein said circumferential section forms a peripheral portion of said front section and wherein said front section is made of glass and is provided with a groove that permits insertion and bonding of said circumferential section.

10. The display device of claim 1, further comprising:

a circumferential section bonded with said front section and said rear section to form said vacuum envelope, wherein said rear section and said circumferential section are made of glass.

11. The display device of claim 1, wherein said rear section resists said vacuum solely by its inwardly convex shape and connection around the periphery thereof without additional stiffening.

12. A display system comprising:

a housing including, a rear section, a front section inwardly curved toward said rear section such that a center portion of said front section is closer to said rear section than a peripheral portion of said front section and having a flurorescent screen provided on an interior surface of said front section, and side sections, connected to said front and rear sections to create a sealed, substantially evacuated interior of said housing;

at least one electron gun, located within said housing, emitting at least on electron beam; and an electrode system, located within said housing, focusing said at least one electron beam onto said fluorescent surface.

13. The display system of claim 12, wherein said rear section has a surface which is inwardly curved toward said interior of said housing, said rear section resisting said vacuum solely by its convex shape and connection around the periphery thereof to said side sections without additional stiffening.

14. The display system of claim 13, wherein said front and rear sections are made of glass.

15. The display system of claim 13, wherein said front section is made of glass and said rear section is made of metal.

16. A display system comprising:

a housing including, a rear section, having an exterior surface inwardly curved toward the interior of the housing, a front section inwardly curved toward said rear section such that a center portion of said front section is closer to said rear section than a peripheral portion of said front section and having a fluorescent screen provided on an interior surface of said front section, and side sections, connected to said front section and said rear section to create a sealed, substantially evacuated interior of said housing;

at least one electron gun, located within said housing, emitting at least one electron beam; and an electrode system, located within said housing, focusing said at least one electron beam onto said fluorescent surface.

17. The display system of claim 16, wherein said front section and rear section are made of glass.

18. The display system of claim 16, wherein said front section is made of glass and said rear section is made of metal.

* * * * *